US005468178A

United States Patent [19]

Kitko et al.

[11] Patent Number: 5,468,178

[45] Date of Patent: Nov. 21, 1995

[54] ROTARY DEVICE FOR REMOVING PAINT FROM A SURFACE

[76] Inventors: Frederick A. Kitko; Frederick R. Kitko, both of 110 Sioux Ave., Bismarck, N. Dak. 58501

[21] Appl. No.: 688,387

[22] Filed: Apr. 22, 1991

Related U.S. Application Data

[63] Continuation-in-part of Ser. No. 480,787, Feb. 16, 1990, abandoned.

[51] Int. Cl.[6] ..... B24D 7/00

[52] U.S. Cl. ..... 451/548; 451/449; 451/28

[58] Field of Search ..... 51/209 R, 209 DL, 51/170 T, 177, 266, 281 R; 29/78, 79; 451/548, 550, 359, 353, 449, 28

[56] References Cited

U.S. PATENT DOCUMENTS

| | | | |
|---|---|---|---|
| 565,873 | 8/1896 | Barr | 51/209 R |
| 2,906,612 | 9/1959 | Anthony et al. | 51/209 R |
| 2,994,942 | 8/1961 | Harvell et al. | 29/79 |
| 2,997,820 | 8/1961 | Skoog | 51/209 R |
| 3,086,277 | 4/1963 | Hardy | 29/78 |
| 3,420,010 | 1/1969 | Tobey | 51/356 |
| 3,745,719 | 7/1973 | Oswald | 51/209 R |
| 4,047,902 | 9/1977 | Wiand | 51/295 |
| 4,720,941 | 1/1988 | Belieff et al. | 51/204 |
| 4,776,402 | 10/1988 | Meikle et al. | 168/48 |
| 4,843,768 | 7/1989 | Stanfield | 51/266 |

*Primary Examiner*—Robert A. Rose
*Attorney, Agent, or Firm*—Arter & Hadden

[57] ABSTRACT

A paint removing device is adapted for attachment to a hand held rotary grinder for fast, efficient removal of paint from a surface. The device includes a disc with abrasive platelets arranged in a ring around the periphery of the disc, leaving a central area free from abrasive particles. Rotation of the disc at high speeds removes paint from the entire area encompassed by the disc.

7 Claims, 3 Drawing Sheets

ROTARY DEVICE FOR REMOVING PAINT FROM A SURFACE

This application is a continuation-in-part, of application Ser. No. 07/480,797, filed Feb. 16, 1990 now abandoned.

BACKGROUND OF THE INVENTION

1. Field of the Invention

This invention relates to the removal of paint from surfaces. More particularly, the invention relates to the fast removal of paint from house siding (and other like surfaces) using a relatively inexpensive and durable rotary abrasive device.

2. Description of Prior Art

The removal of paint from surfaces such as house siding has long been a laborious task performed in the most part by professional exterior decorators due to the time consuming nature of the task. Those dedicated home owners that desire to strip paint from siding must make do with heat equipment which is by its very nature slow, and also liable to scorch the wood uncovered. Alternatively, time may be taken to scrape or sandpaper the paint from the siding. Both the latter methods are extremely slow and the use of sandpaper extremely frustrating due to continual load-up or clogging of the paper requiring its frequent replacement.

U.S. Pat. No. 2,997,820 of Skoog is illustrative of prior art sanding devices. The device uses the outer edge of the wheel to remove the bumps and irregularities encountered. The wheel is bell shaped so that only the edge of the wheel is used to remove the surface.

U.S. Pat. No. 3,745,719 of Oswald illustrates a floor grinding machine that utilizes durable carbide buttons to prevent uneven wear of the diamond matrix abrasive portions used to grind the floor. This protects the disc holding the diamond matrix from uneven wear.

U.S. Pat. No. 4,023,313 of LeBlanc illustrates the use of tungsten carbide abrading chips on a sanding and stripping device. The entire area of rotation of the grinder is abraded on rotation.

The prior art demonstrates the use of abrasive materials to grind or sand. All the devices discussed above require movement of the abrasive portions of the device over a surface for grinding. The devices do not allow a fast efficient and effective method of removing paint from a surface. They are more concerned with sanding and as such are designed for evenness of the finished surface. The entire surface must be painstakingly covered by the devices. This is especially the case with the Skoog device. The Oswald device utilizes expensive diamond matrices for abrading that makes the device itself expensive. The location of the matrices would also mean that the abrasive regions may be prone to clogging. The requirement for coverage of the entire region would also make their use relatively slow. The LeBlanc device is necessarily heavy and is therefore unsuited to being hand held. In addition, the position of the carbide matrices give no viable way of clearing debris from the blades to prevent clogging.

To enable a paint stripper to conveniently remove paint from siding in a fast, effective method requiring a device that can be hand held and is reasonably priced, is desirable.

OBJECT OF THE INVENTION

Accordingly it is an object of this invention to provide an improved paint removing device that meets the aforementioned needs.

It is a specific object of this invention to provide a cost effective paint removing device suitable for use on painted siding that is simple to operate and that removes paint at a fast rate.

Other objects, advantages and features of this invention will become apparent on reading the following description and appended claims, and upon reference to the accompanying drawings.

SUMMARY OF THE INVENTION

The annulus surrounds a central portion of the disc that is free from abrasive particles. The annulus may be formed from a plurality of abrasive platelet secured to the disc periphery. The platelets do not form a continuous surface but are separated one from another to provide radially extending gaps therebetween. In this arrangement, the platelets provide abrasive portions. Alternatively, the abrasive portions could be secured directly on the disc. These radially extending gaps are narrow relative to the abrasive portions and provide passage from the center to the outside of the annulus. The central portion is substantially circular.

The abrasive particles may be chips of carbide, preferably tungsten carbide. The carbide chips may be secured to the platelets by flux preferably silver solder. The chips are randomly oriented to provide both positive and negative radius rakes that draw particles of paint removed from a surface out from the platelets to prevent clogging of the abrasive portions.

Although the device is operable at low rates of rotation, it is preferable for the disc to be rotated at a sufficient rate to provide an average linear speed to the carbide chips in excess of 2100 inches per second. At this rate of rotation the paint surface covered by the central portion of the disc is removed without abrasion when wood surface is perfectly flat. At lower rotational speeds this tends not to happen and when wood surface is irregular.

BRIEF DESCRIPTION OF THE DRAWINGS

For a more complete understanding of this invention, reference should now be made to the embodiment illustrated in greater detail in the accompanying drawings and described by way of example only. In the drawings.

DETAILED DESCRIPTION OF THE DRAWINGS

Figure 1:
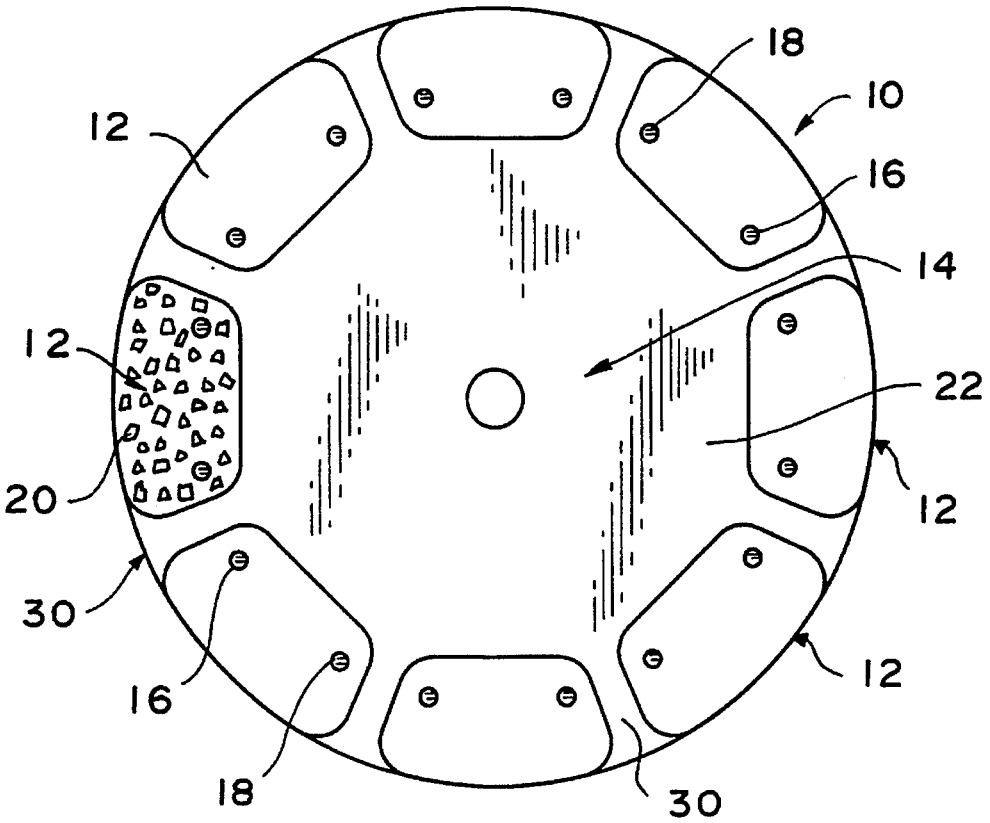
FIG. 1 is an elevation of the face of the paint remover of this invention.
Figure 2:
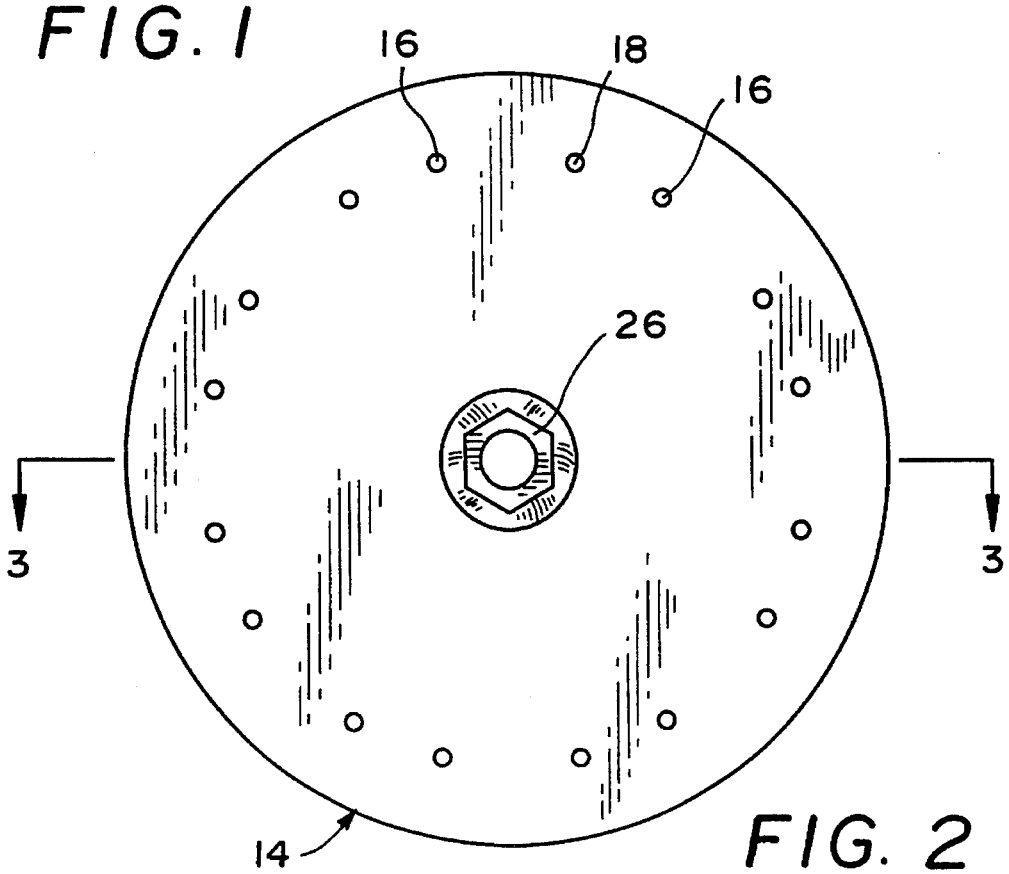
FIG. 2 is a bottom elevation of the paint remover of FIG. 1.
Figure 3:
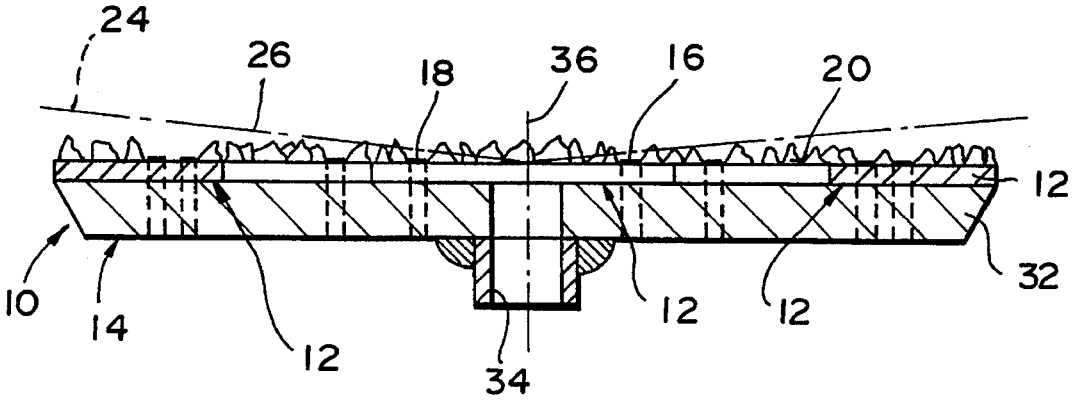
FIG. 3 is a sectioned view taken along the line 3—3 through the paint remover of FIG. 2.

Turning now to FIG. 1 of the drawings, the abrasive face of a paint remover 10 of this invention can be seen. The paint remover 10 has a circular peripheral edge and is adapted by the use of a nut 26 to be attached to and rotatively driven about an axis 36. The driving device may take the form of that rotary grinder as manufactured by Makita. Other grinders, principally those used in grinding metal, drills or like devices (not shown), having sufficient RPM are also suitable. The paint remover 10 has eight platelets 12 positioned around the periphery of a flat steel disc 14. Each platelet 12 is secured to the disc 14 by a pair of rivets 16, 18. The platelets 12 are illustratively made from stainless steel and affixed to each are a plurality of abrasive particles illustratively taking the form of tungsten carbide chips 20. The platelets 12 are arranged to form an abrasive annulus on the disc 14 leaving a central area 22 free from abrasive chips 20. FIG. 3 shows a sectioned view of the paint remover 10 as shown in FIGS. 1 and 2, particularly illustrating the absence of the abrasive chips 20 in the central area 22, which is disposed concentrically with respect to the axis 36. For the purposes of illustration, a dotted line 24 has been drawn in FIG. 3 to illustrate that surface presented to the paint to be removed. That surface 24 is generally concave with respect to the paint to be removed and, as is well known in the machining arts, that type of surface 24 is said to be configured as a negative or female radius (as opposed to a positive or male radius). The beneficial effect of such a negative radius configuration will be detailed below.

The disc 14 is configured to withstand the stresses of the high speeds of rotation at which it will be utilized. The eight platelets 12 are separated from each other to provide radially extending gaps 30 therebetween, to thereby minimize stress on the disc and therefore prevent cracking, shattering, or other damage that might reduce the life of the device and safety to the user. The disc 14 is also provided with a chamfer 32 disposed at 60° with respect to the back surface of the disc 14, as can be seen in FIG. 3 to facilitate abrasion around doorways and windows.

The disc 14 is five inches in diameter in one illustrative embodiment. The bottom elevation of the disc (FIG. 2) shows clearly the nut 24 configured to thread on to the arbor of the rotary grinder (not shown) and secured as by welding to the back or bottom surface of the disc 14. The disc 14 can be directly attached to the rotary grinder or preferably, bushings can be used to hold the disc away from the rotary grinder to protect the hands of the operator and to keep the disc 14 plush with the end of the arbor. A safety shield may also be used for extra protection.

The points and edges of the fractured faces 26 of the tungsten carbide chips 20 provide the cutting action and can be seen most clearly in FIG. 3. The chips range in dimension of 5/32 to 7/32 of an inch are preferred provide a good cutting action. Larger chips tend to remove more surface than required and smaller chips require a larger number of rotations to completely remove paint from the surface. This is due to a reduction in abrasion on any one rotation in comparison with an annulus with larger chips. An abrasive surface formed from chips smaller than 5/32 inch is likely to be more prone to clogging.

Tungsten carbide is the preferred material for the chips because of its durability. As long as chips of tungsten carbide are pointed or have a prominent fractured edge facing upward, these points and edges are not subject to dulling. If a particular chip 20 has a flat upper face, it will tend to be honed and not act as a good cutting edge. In a large number of chips at random orientation it is unlikely that there will be a large number of flat topped chips and the function of abrading will not, therefore, be impaired. When the chips 20 are abraded by hand, care must be taken to ensure that the unlikely does not happen and that there are not an excess of flat topped chips on the platelets 12. This can be achieved by hand orientating the chips 20 on the platelets 12 to ensure that sharp cutting edges or rakes of the chips 20 are disposed to cut the paint and that the rounded chip surfaces abut the front or mounting surface 23 of the disc 14.

Figure 4:
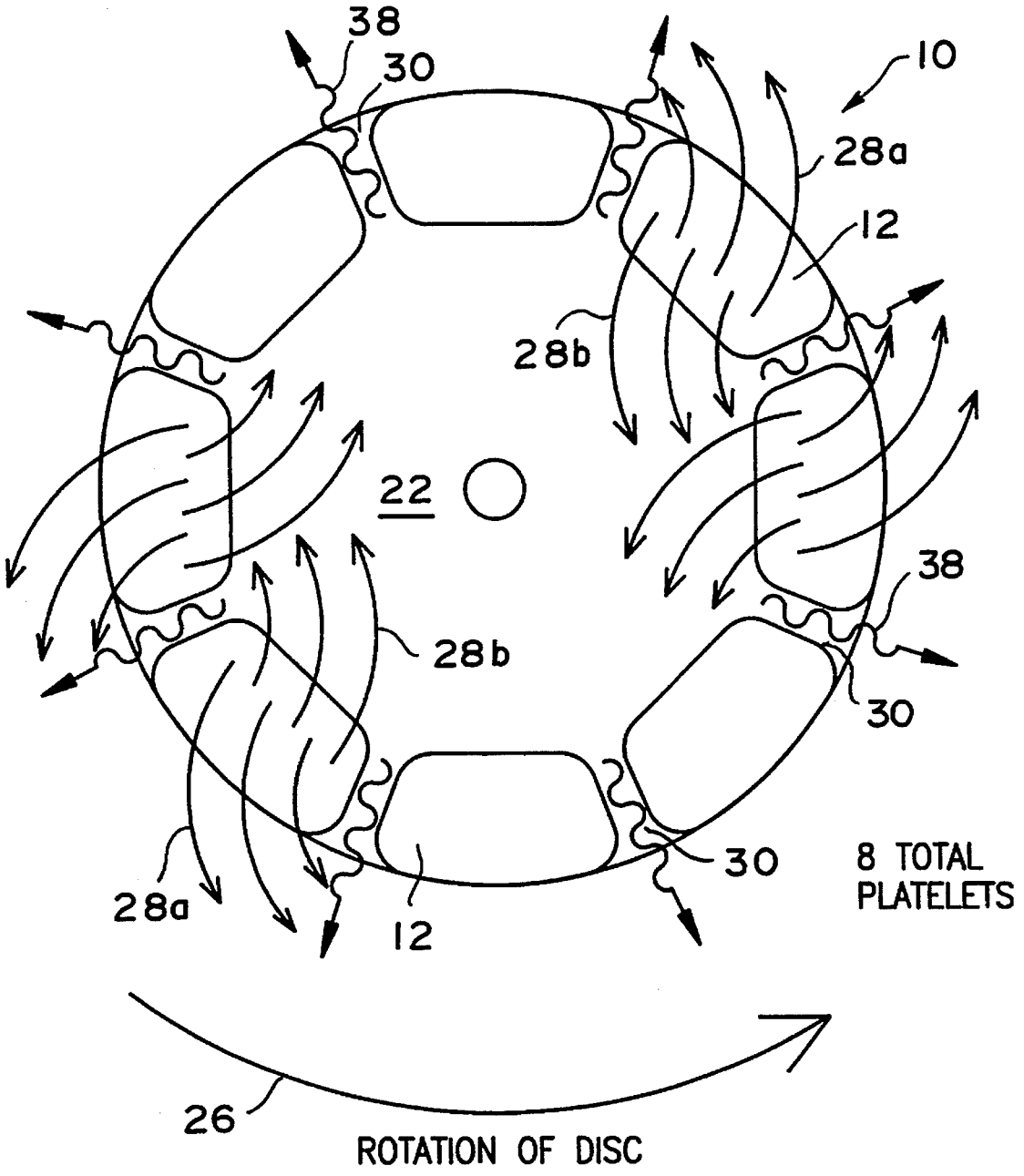
FIG. 4 is a schematic representation of the paint remover indicating the direction of movement of paint chips removed by the device.

Further, it has been found that controlling the density of distributing the chips 20 on the platelets 12 to not exceed a maximum value in the order of 60 chips per square inch, ensures that paint will not clog the disk 14 and decrease the efficiency of the paint removal. It can be appreciated that if the density of the chips was increased significantly above this maximum value, that the disk would tend to act as sand paper which as described above quickly becomes clogged so that the efficiency of paint removal decreases significantly. In actual use, a disk 14 with platelets 12 having chips 20 disposed thereon of approximately 60 chips per square inch continuously removed paint in an efficient fashion without clogging and without need for periodic cleaning of the disk. Further, the platelets 12 and the passages 30 there-between define an annular area of the surface of the disc 14. The chips 20 need be distributed over at least 50% of that annular surface area in order for the disk 14 to remove paint efficiently. If for example, the area of the passages 30 without chips becomes larger than 50% of the annular surface area, paint removal efficiency will suffer. As indicated in FIG. 4, the paint particles are thrown from the disk 14 due to disk rotation and the controlled density of the chips 20 on the platelets 12 into the central portion 22 of the disk 14 as indicated by the arrows **28*b* and are also thrown outward as indicated by the arrows 28*a*. The result of disk rotation and maintaining the desired chip density is that paint does not clog between the chips 20 even after prolonged use. In actual use, a disk 14** so configured was used to remove four coats of latex paint from a two-bedroom house without the need for cleaning, an unexpected improvement in view of the prior art experience of clogging and significantly reduced efficiency due to clogging of ordinary sand paper.

Figure 5:
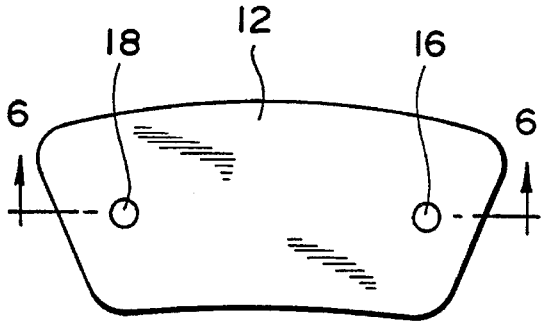
FIG. 5 is a view of one platelet of the paint remover of FIG. 1.
Figure 6:
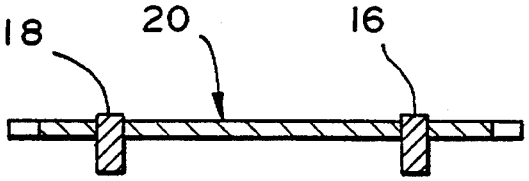
FIG. 6 is a sectioned view taken along the line 6—6 through the platelet of FIG. 5.

The stainless steel platelets 12 are attached to the steel disc 14 by using stainless steel rivets 16, 18, 1/8 of an inch in diameter. The rivets 16 are driven through the platelets 12 and into the base of the disc 14. Their location in relation to the platelets 12 can be seen in FIG. 5. To attach the chips 20 to the surface of the stainless steel platelets 12, the platelet surfaces must first be gleaned by abrasion or acid. Once the platelets 12 are attached to the disc 14, the abrading or acid process by which the tungsten carbide chips are affixed to the platelets, can be started.

In an illustrative method, the platelets 12 are coated with a silver solder flux 28 and the cracked chips 20. The chips 20 are graded to ensure their size falls within the required limits of 5/32 to 7/32 of an inch. The graded chips are placed in an open coat arrangement on the flux 28. Each platelet 12 is heated until the silver solder 28 is accepted by the platelet 12 and the carbide chips 20 are accepted by the silver solder 28. The abrading process heats the steel disc 14 and as it gradually cools a firm bond between the carbide particles 20 and the platelet 12 is formed. Though it is contemplated that the manufacture of the paint remover 10 of this invention may be automated, the initial devices were handmade. In such an illustrative embodiment, the chips 20 were cracked and/or fractured from carbide tools The resultant chips 20 were irregular in size and were not of equal height. It is contemplated that in such an embodiment, a slight dressing or grinding of the chips 20, after they are attached to the disc 14, would eliminate the highest cutting edges from the chips 20 and, thereby, reduce the swirls imparted by the paint remover 10.

Figure 7:
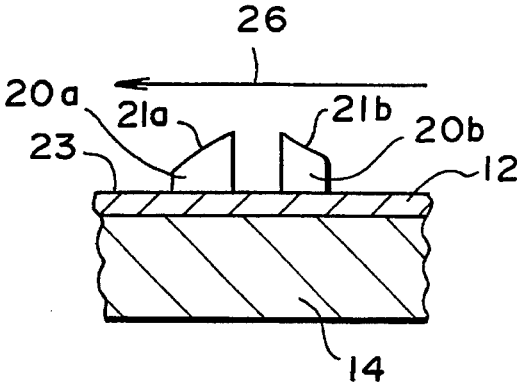
FIG. 7 is an enlarged segment of a section through the platelet of FIG. 5 showing the random orientation of the abrasive chips thereon.

The random orientation of the fractured surfaces 26 of the chips 20 achieved by the hand placement of chips 20 on the platelets attachment by abrading in addition to reducing wear, serves to prevent the abrasive platelets 12 from becoming clogged. In combination with the negative radius configuration, the random orientation of the chips 20 provide both positive and negative rake to the particles of paint removed by the paint remover 10 through the angular orientation of the fractured cutting edges of the chips 20. The cutting edges throw paint particles in directions away from their point of origin as indicated by the arrows 28*a* and 28*b* in FIG. 4. Although the movement of particles is shown for only four of the platelets 12, each of them operates in the same manner. Referring now to FIG. 7, there is shown an enlarged segment of a cross-section through one of the platelets 12 and its supporting disc 14. Only two chips 20*a* and 20*b* are disposed secured to a top or front surface 23 of the platelet 12, for clarity. It is understood that most chips 20 have a cutting edge or rake 21, which is not parallel to the front surface 23, but rather slopes at an angle with respect to the surface 23. It is significant that the particles 20 are disposed in a random orientation as explained above. Some chips 20, of which chip 20*a* is illustrative, are said to have a positive rake in the sense that their cutting edge or rake 21*a* slopes from a maximum height downward toward the surface 23 in a direction that generally coincides with the direction of rotation of the disc 14 as indicted by an arrow 26. Other chips 20, of which chip 21*b* is illustrative, are said to have a negative rake in the sense that their rake 21*b* slopes from a high point downwardly toward the surface 23 in a manner that it points in a direction substantially opposite to the direction of disc rotation as indicated by the arrow 26.

The effect of the random orientation of the chips 20 on each of the platelets 12, i.e., the disposing of the chips 20 so that their rakes 21 have positive and negative orientations, is to remove the paint particles from the chips 20 along paths as shown by the arrows 28*a* and 28*b* in FIG. 4. Note that the arrows 28*a* and 28*b* are drawn for the rotation of the paint remover 10 in a counter-clockwise direction as shown by the arrow 26. More particularly, it is believed that those chips 20*b* with a negative rake 21*b* will remove paint particles and throw them toward the center axis 36 and into the central area 22. These particles are also being rotated due to the rotation of the paint remover 10. A centrifugal force due to disc rotation will direct the paint particles through the gaps 30 between the platelets 12, as indicted by the arrows 38. The chips 20*a* with a positive rake 21*a* are believed to throw their paint particles radially outward as indicated by the arrows 28*a*, whereby those paint particles are directly removed from the paint remover 10. Thus, a significant problem in the prior art, i.e., the clogging of the abrading surface, is significantly reduced by the configuration of the platelets 12, controlling the density of the chips 20 and the random orientation of the chips 20 thereon.

In operation, the disc 14 is rotated in excess of 7,000 revolutions per minute, preferably as fast as 10,000 rpm although there is no known upper limit. The abrasive chips 20 on the face of the disc 14 are placed in contact with a surface from which paint is to be removed. The rotating of the disc 14 causes a ring of paint to be removed by abrasion. At these high rates of rotation, approximately 10,000 rpm, however, there is another more surprising effect on contact between the disc 14 and the painted surface. Without moving the disc 14 from its position of initial contact with the surface, not only is paint removed from the surface in contact with the abrasive region, it is also removed from the portion of the surface covered by the central area 22.

It is believed that sound or other waves created by abrading at a high rate of revolution may be responsible. The sound or other waves propagated as a result of the high frequency rotation cause the paint to shatter into small flakes that are removed along with the abraded particles. If this is indeed the case it is likely that the linear speed at which the carbide chips pass over the painted surface will be of importance. With a five inch diameter disc 10,000 rpm has been found to be sufficient, with larger discs, however, a lower rpm may create the same phenomenon. Similarly, smaller discs may require higher rpms. With regard to the illustrative paint remover 10 as shown in FIG. 4, it is seen that the outermost chips 20, which are disposed upon the platelets 12, have an effective radius of almost 2.5 inches with respect to the central axis 36. The chips 20 that are disposed on the platelets 12 closest to the axis 36 may only have an effective radius of approximately 1.5 inches, when the width of the platelets 12 is illustratively 1 inch. For such an illustrative dimensioned paint remover 10, the outermost chips 20 will move with a linear velocity in the order of 2,600 inches per second, whereas the innermost chips 20 will move with a lesser linear velocity of slightly less than 1600 inches per second. Thus, a chip 20 disposed centrally of the platelets 12, i.e., having a radial placement of 2 inches from the axis 36, will move at an average linear velocity of about 2,100 inches per second. Under these conditions, for the illustrative paint remover 10 with a 5 inch diameter, it has been observed that not only will paint be removed in the area corresponding to the abrasive annulus of the platelets 12, but also within the central area 22 of the paint remover 10.

The negative radius configuration of the platelets 12 and the positive and negative rakes contributed by the carbide chips 20 combine to cause the paint particles removed from the surface to move in the directions indicated by the arrows 28*a* and *b* in FIG. 4. The high speed of rotation is thought to also contribute to the motion of the particles. This contribution may be attributable to the creation of a partial vacuum on rotation of the disc. The vacuum would be greater toward the edge of the disc due to the faster motion of air trapped by the device at this location.

The motion of paint particles relative to the disc prevents clogging of the platelets 12 during operation. Although at high speeds of rotation the contact necessary between the disc 14 and the painted surface in order to remove paint is minimal, use of the paint remover may result in the creation of very shallow swirls in the surface from which paint has been removed by abrasion. These swirls are easily removed from wood by a light sanding of a sander.

The paint remover described above is highly efficient. Because of the effects mentioned above, a disc five inches in diameter having an abrasive ring of about an inch radius around its periphery can remove paint from a circular area five inches in diameter without moving the disc from its original position of contact. This phenomenon enables a square foot of paint to be removed in less than a minute. The construction of the paint remover and the use of carbide chips as the abrasive medium ensures a long life for the disc. It is estimated that paint can be removed from the siding of at least three houses with one disc. This should be sufficient for the lifetime of any householder. The device has the added advantage of avoiding clogging during use. The attachment of the platelets to the disc by rivet facilitates replacement of the platelets without changing disc if this is desirable.

Although the five inch disc is considered the most conveniently sized, discs of other sizes both smaller and larger may be used in the same manner. At rotations below those required to remove the paint covered by the central area, the disc is still an effective paint remover as the geometry of the platelets and carbide chips prevents clogging of the abrasive portions that can cause problems in other abrasive paint removers. The device described above has obvious advantages over the relatively slow process of heat removal and even greater advantages over sanding in providing a highly effective and efficient paint remover at a price not prohibitive to the home owner.

While one preferred embodiment of this invention is illustrated, it will be understood, of course that the invention is not limited to this embodiment. Those skilled in the art to which the invention pertains may make modifications and other embodiments employing the principles of the invention, particularly upon considering the foregoing teachings.

What is claimed is:

1. The method of removing paint from a surface using a paint removing apparatus adapted to be rotated for abrading and efficiently removing paint from a painted surface while minimizing the effect on the surface, said apparatus comprising:

(a) a rigid disc member to driven rotatably about a central axis in a given direction and having at least one disk surface; and (b) a plurality abrasive chips disposed on an annularly shaped surface raised with respect to said disk surface, each abrasive chip having at least one cutting edge and secured to said annularly shaped surface to present its cutting edge to abrade the painted surface, said annularly shaped surface being disposed at a radical distance from said central axis to define a central surface of said disk surface free of said abrasive chips, said abrasive chips being secured to said annularly shaped surface so that said one cutting edge of some of said abrasive chips has a negative rake with respect to said given direction to effect efficient removal of the abraded paint particles from the painted surface and to prevent said abrasive chips from being clogged with the abraded particles of paint, said method compromising the step of:

rotating said disc member at a rotational velocity in the order of 10,000 rpm, whereby paint adjacent said free area is removed.

2. Paint removing apparatus adapted to be rotated for efficiently removing paint from a surface, while minimizing the affect on the surface itself, said apparatus comprising:

(a) a rigid disc member rotatable about a central axis and having at least one disc surface; and (b) a plurality of platelets disposed in an annular array, each platelet secured to said disc surface and having a mounting surface raised with respect to said disc surface for receiving a plurality of abrasive chips, each abrasive chip having at least one cutting edge and secured to said mounting surface to present its cutting edge to abrade the painted surface, said annular array being disposed at a radical distance from said central axis to define a central area of said disc surface free of said abrasive chips, each of said plurality of platelets being spaced from adjacent platelets to define therebetween radically oriented slots of an equal width, each of said slots being defined by said disc surface and said sides of said adjacent platelets.

3. The method of removing paint from a surface using a paint removing apparatus adapted to be rotated for efficiently removing paint from a painted surface while minimizing the effect on the surface itself, said apparatus comprising a rigid disk member rotatable about a central axis and having at least one disc surface disposed toward the painted surface, said disc surface lying in a plane disposed substantially perpendicular to said central axis, and said disc surface comprising a first annular surface for mounting a plurality of abrasive chips and a second central surface, each abrasive chip having at least one cutting edge and secured to said first annular surface to present its cutting edge to abrade the painted surface, said first annular surface being disposed at a radial distance from said central axis to define said second central surface, said first annular surface being raised with respect to said second central surface to enhance the removal of paint particles by suction, said second surface being free of said chips;

said method comprising the step of rotating said disc member at a speed in the order of 2,100 inches per second such that paint adjacent said free surface is removed.

4. A paint removing apparatus adapted to be rotated for efficiently removing paint from a painted surface while minimizing any effect on the surface itself, said apparatus comprising:

(a) a rigid disk member rotatable about a central axis and having at least one disk surface disposed toward the painted surface; and (b) said disk surface including a first annular surface for mounting a plurality of abrasive chips and a second central surface, each abrasive chip having at least one cutting edge and secured to said first annular surface to present its cutting edge to abrade the painted surface, each abrasive chip having a maximum dimension less than a value that would distort the painted surface, said first annular surface being disposed at a radial distance from said central axis to define said second central surface and being free of said abrasive chips, said abrasive chips being distributed over at least 50% of the area of said first annular surface.

5. The paint removing apparatus of claim 4, wherein said maximum dimension is set in the order of 7/64th inch.

6. The paint removing apparatus of claim 4, wherein said abrasive chips are distributed in said first annular surface of a density not to exceed 60 chips per square inch.

7. The paint removing apparatus of claim 5, wherein said abrasive chips are distributed on said first annular surface with a density not to exceed 60 chips per square inch.

* * * * *